United States Patent [19]

Lagofun

[11] 4,329,924

[45] May 18, 1982

[54] ELECTRIC PRIMER WITH CONDUCTIVE COMPOSITION

[75] Inventor: Guy J. Lagofun, Tarbes, France

[73] Assignee: Etat Francais represente par le Delegue General pour l'Armement, Paris, France

[21] Appl. No.: 74,541

[22] Filed: Sep. 11, 1979

[51] Int. Cl.[3] ..... F42C 19/12

[52] U.S. Cl. ..... 102/202.8

[58] Field of Search ..... 102/203, 46, 28 R, 472, 102/202.5, 202.8, 202.9

[56] References Cited

U.S. PATENT DOCUMENTS 2,696,191 12/1954 Sheehan ..... 102/203
3,018,732 1/1962 Tognola ..... 102/46
3,198,117 8/1965 Purdy et al. ..... 102/28 R
3,455,244 7/1969 Ballreich et al. ..... 102/203
3,828,677 8/1974 Kaszupski ..... 102/46

*Primary Examiner*—Charles T. Jordan
*Attorney, Agent, or Firm*—Stevens, Davis, Miller & Mosher

[57] ABSTRACT

The primer comprises a conductive pyrotechnical priming composition 3, placed in contact with the useful pyrotechnical charge 2 of the primer and two electrodes 6 and 7 arranged in electrical contact with the conductive pyrotechnical composition 3.

The two electrodes 6 and 7 are connected to a stable electric resistor 10, connected in parallel to the conductive pyrotechnical composition 3.

5 Claims, 2 Drawing Figures

ELECTRIC PRIMER WITH CONDUCTIVE COMPOSITION

The present invention relates to an electric primer comprising a conductive pyrotechnic priming composition.

In such primers, the igniting of the conductive pyrotechnical composition is effected by placing two electrodes arranged in electrical contact with the said conductive pyrotechnical composition under voltage.

In one known embodiment, one of these electrodes consists of a metallic washer while the other electrode is formed of a metal body having a flat surface parallel to the said washer. Said metallic washer is separated from the flat surface of the metallic body by another washer of dielectric material. The cylindrical cavity defined between these two washers is filled by the said conductive pyrotechnical composition.

This conductive pyrotechnical priming composition is furthermore placed in contact with the useful pyrotechnical charge of the primer which may consist, for instance, of mercury fulminate, lead trinitroresorcinate, lead nitride or tetrazine.

The conductive pyrotechnical priming composition may be formed of an explosive selected from among the said compounds to which there is added a particulate conductive material such as graphite.

The primers of conductive pyrotechnical composition of the type indicated above present various drawbacks.

First of all, it is difficult to assure perfect homogeneity of the conductive pyrotechnical composition, so that upon mass production considerable dispersion is noted between the electrical resistances of the different samples of composition.

Furthermore, even a relatively slight parasitic electric current may cause the accidental initiating of these primers. In addition, these primers are very sensitive to discharges of electrostatic origin. Moreover, it is found that the electrical resistance of the conductive pyrotechnical compositions changes in time, which results in substantial modifications in the operating conditions of these primers. Moreover, experience has shown that the dielectric washer which serves as an insulating bridge between the electrodes of the primer may form an electrostatic tank which may be the cause of accidental operation.

Tests have shown furthermore that the initiation energy range of these primers is very broad. In fact, for certain low voltages the primer can by way of exception operate with a few microjoules of energy, while on other primers exceptional misfirings can be noted upon firing with an energy on the order of a joule.

Most of the above-mentioned drawbacks can be explained by the fact that the electrical resistance of the conductive pyrotechnical composition varies as a function of the electrical energy applied to it. This is due to the fact that the conductive particles (generally of graphite) are distributed non-uniformly within the pyrotechnical composition of these primers. Under a relatively low tension the current flows between these conductive particles along lengthy sinusoidal paths. On the other hand, when the primer is subjected to a rather high voltage the said current paths are short-circuited by micro-arcs, so that the primer operates on a dynamic resistance of a value definitely less than its static resistance under low voltage. It will therefore be understood that under these conditions firing can be effected at a very low energy threshold.

The object of the present invention is to create a pyrotechnical composition primer which is of a safety and a reliability in operation which are definitely better than those of the known primers.

The electrical primer of the present invention comprises a conductive pyrotechnical priming composition placed in contact with a useful pyrotechnical charge and two electrodes arranged in electrical contact with the said conductive pyrotechnical composition.

In accordance with the invention, the two electrodes are connected to a stable electric resistor connected in parallel with the conductive pyrotechnical composition.

As a result of this stable electrical resistor which is connected in parallel with the conductive pyrotechnical composition, the firing energy is distributed between said parallel resistor and the pyrotechnical composition. There is thus obtained a constancy in operation of the primer which is superior to what is obtained in the known embodiments.

Moreover, the placing of the said stable resistor in parallel with the conductive composition which varies greatly as a function of the energy applied results in a considerable desensitizing of the primer at the level of the misfire thresholds without this significantly influencing the threshold of definite operation of the primer.

The invention applies preferably to electrical primers in which one of the electrodes is formed of a metallic washer and the other electrode is formed of a metal body having a flat surface parallel to the said washer.

In accordance with a preferred version of the invention, the said washer is separated from the flat surface of the metal body by a washer of electrically resistant material, constituting the electric resistor in parallel, the cavity created by these washers being filled by the conductive pyrotechnical composition. This washer of electrically resistant material therefore replaces the washers of dielectric material which have been used in the known electrical primers.

In accordance with one advantageous embodiment of the invention, the electrical resistor in parallel has an ohmic value which is substantially between 0.8 and 2 times that of the resistance of the conductive pyrotechnical composition.

This resistor which is connected in parallel with the conductive pyrotechnical composition can be made of a graphite-filled thermoplastic material, which makes it possible easily to obtain a resistance having an ohmic value of the same order of magnitude as that of the conductive composition.

Other details and advantages of the invention will become evident from the following description.

In the accompanying drawings, which are given by way of illustration and not of limitation:

Figure 1:
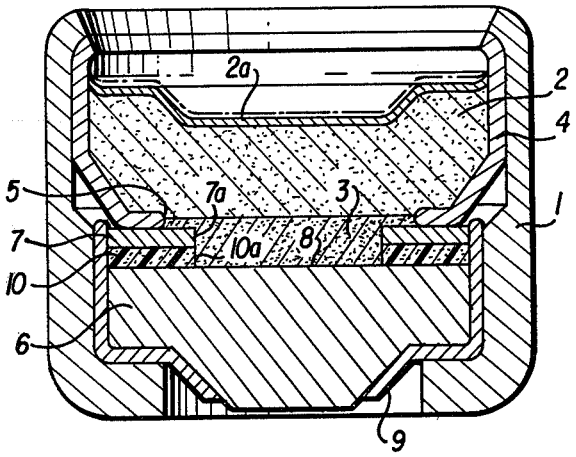
FIG. 1 is a longitudinal section through an electric primer in accordance with the invention.

Referring to FIG. 1, the primer in accordance with the invention comprises a substantially cylindrical outer metal envelope 1 enclosing the useful pyrotechnical charge 2 of the primer and the conductive composition 3. The useful pyrotechnical charge 2 is separated from the outer metal envelope 1 by a cup 4 of metal the bottom of which is provided with a central opening 5. The useful pyrotechnical charge 2 is covered by a metal dish 2*a* which compresses this charge 2 towards the conductive pyrotechnical composition 3. This conductive composition 3 is in contact with the useful charge 2 via the central opening 5 of the insulating cup 4.

The conductive composition 3 is placed in electric contact with two electrodes 6 and 7. The electrode 6 consists of a metallic body having a flat surface 8 in contact with the conductive composition 3. The electrode 7 is a metal washer arranged below the metal cup 4, parallel to the flat surface 8. The washer 7 and the metal body 6 are insulated electrically with respect to the outer metal envelope 1 by an insulating cup 9 which surrounds said washer and said body 6.

Furthermore, the flat surface 8 of the body 6 is separated from the washer 7 by another washer 10 of dimensions substantially identical to those of the washer 7. This washer 10 has a stable predetermined electric resistance as a function of the energy which is applied to it. The cylindrical cavity defined by the openings 7*a* and 10*a* of the washers 7 and 10 is filled by the conductive pyrotechnical charge 3.

The washer 10 constitutes an electrical resistor connected in parallel with the resistor formed by the conductive composition 3.

The resistance of this washer 10 is preferably substantially between 0.8 and 2 times the intrinsic resistance of the conductive pyrotechnical composition 3.

The resistor 10 may be made of a thermoplastic material or rubber made conductive by means of particles of graphite.

The proportion by weight of graphite is preferably between 3 and 10%, referred to the total weight of the washer 10. Upon the manufacture of the resistant washer 10, the latter is compressed under a pressure on the order of 1000 bars. Under these conditions, this washer 10 has a resistivity of between 300 and 2000 ohms-cms, depending on the graphite content.

In order to assure a good electrical contact between the resistant washer 10 and the electrodes consisting of the washer 7 and the body 6, said resistant washer 10 is compressed between these two electrodes 6 and 7 under the effect of the pressure exerted by the useful charge 2.

The operation of the electrical primer of the invention will now be described with reference to FIG. 2.

Figure 2:
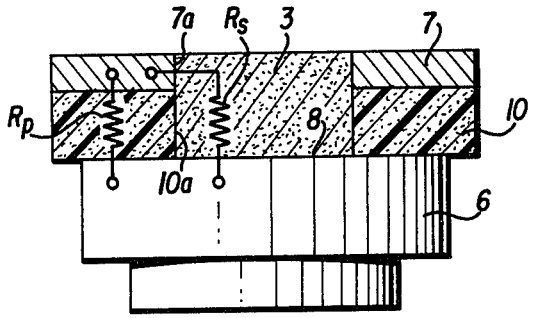
FIG. 2 is a diagram which illustrates the operation of the electric primer in accordance with the invention.

In accordance with the diagram of FIG. 2, it can be seen that the washer 10 arranged between the electrodes 6 and 7 is equivalent to a resistor Rp connected in parallel with the resistor Rs formed of the conductive pyrotechnical composition 3. Under these conditions, upon the firing of the primer, the firing energy is distributed between the composition 3 and its parallel resistor formed of the washer 10. Since the electrical resistance of the conductive composition 3 varies greatly as a function of the energy applied to the electrodes 6 and 7, the placing of a fixed resistor in parallel with the resistance of said composition 3 makes it possible considerably to desensitize the primer at the level of the misfire threshold without thereby significantly affecting the threshold of definite operation of the primer.

This result can be shown by means of the following calculations:

In the case of a voltage U=1 (unity) applied between the electrodes 6 and 7 of the primer, in static condition, the energy W consumed in the primer is equal to (1/Rs+1/Rp) t in which relationship Rs is the static resistance of the conductive composition 3, Rp the resistance of the washer 10, and t the time.

The ratio $W_{Rs}/W$ of the energy consumed in the conductive composition 3 to the total energy W is equal to $$\frac{(1/Rs)t}{(1/Rs + 1/Rp)t}$$

As Rs is in general on the same order of magnitude of Rp it will be assumed, for purposes of simplification, that Rs=Rp. Therefore, $W_{Rs}/W$ is equal to $\frac{1}{2}$.

Under dynamic conditions, the dynamic resistance of the conductive composition 3 is equal to 1/k Rs, in which k may vary between 2 and 10, within the range of the electrical energies considered by the present invention.

In this case: $W_{Rd}/W = k/(1 + k)$

For $k = 2$ $W_{Rd}/W = \frac{2}{3}$

For $k = 5$ $W_{Rd}/W = 5/6$

For $k = 10$ $W_{Rd}/W = 10/11$

The above calculations show that under static conditions the conductive composition 3 dissipates only one-half of the energy applied while it dissipates a much higher fraction as soon as the dynamic resistance Rd becomes very different from the static resistance Rs.

The difference between the so-called safety voltage and the so-called operating voltage considerably amplifies the energy difference consumed in the primer at the corresponding threshold.

In practice, the so-called operating voltage is equal to about 2 to 3 times the safety voltage. The corresponding voltage difference greatly favors the feeding of current into a resistor of dynamic behavior which is then much weaker. In this case, the probability of operation increases for the same energy, which results in low energies of initiation of the primer while, at low voltage, this probability, which is greatly decreased by the primer in accordance with the invention requires an enormous amount of energy.

Therefore, the total electrical resistance formed by the intrinsic resistance Rs of the composition 3 and the fixed resistance Rp of the washer 10 connected in parallel with the latter is more precise than in the case of a conventional primer. Furthermore the combining of two given precision resistors leads to a compensation for static errors which is greater than their dispersion.

Moreover the electrical resistance of the primer in accordance with the invention changes much less with time than in the case of the known primers. As a matter of fact, the placing of a fixed resistor in parallel with the resistance of the conductive composition 3 decreases relatively the change in resistance.

There are given below by way of example the comparative characteristics and performances of a conventional primer and a primer in accordance with the invention which differs from the latter by the fact that it comprises a resistant washer 10 placed between the electrodes 6 and 7 instead of an electrically insulating washer.

| Diameter | Conventional primer 8 mm | Primer in accordance with the invention 8 mm |
|---|---|---|
| Nature of the washer contained between the electrodes | cellulose acetate | graphite-filled rubber |
| Thickness of this washer | 0.10 mm | 0.20 mm |
| Nature of the ignition charge | lead trinitro-resorcinate, potassium chlorate, barium nitrate, calcium silicide, graphite | lead trinitro-resorcinate, potassium chlorate, barium nitrate, calcium silicide, graphite |
| Average resistance | 70 ohms | 48 ohms |
| Standard difference from the average resistance | 35% | 25% |
| Change of resistance upon aging for one month | 13–20% | 3–5% |
| Voltage of definite non-operation | 3–4 volts | 6–8 volts |
| Energy of operation at 10 volts (safety voltage) | | |
| -with 99% misfires | 5 to 10 microjoules | 2000 to 5000 microjoules |
| -with 99% operation | 200 to 1000 microjoules | 50,000 to 400,000 microjoules |
| Energy of operation at 18 volts (operating voltage) | | |
| -with 99% misfires | 5 to 10 microjoules | 40 to 100 microjoules |
| -with 99% operation | 160 to 400 microjoules | 300 to 1000 microjoules |
| Operating time of the primer under the normal firing energy | <80 microseconds | <80 microseconds |

Upon comparing the numerical data given in the above table it is seen that the primer in accordance with the invention has pyrotechnical performance characteristics close to those of the conventional primer. On the other hand, the primer of the invention has a slightly more constant resistance and is definitely more stable with time.

Furthermore, the voltage threshold for definite misfire increases on the average from 3.5 to 7 volts approximately. At 10 volts, at the safety threshold, the primer of the invention is about 1000 times less sensitive than the conventional primer, which is considerable. However, with a voltage of 18 volts, that is to say at the operating threshold of the primer, the primer of the invention is only one-half as sensitive than the conventional primer, which is negligible in practice.

The primer of the invention therefore provides definitely greater operating safety than the conventional primer.

Of course, the invention is not limited to the example which has just been described and numerous modifications may be made therein without going beyond the scope of the invention. Thus the invention applies just as well to primers operating under low voltage (10 to 20 volts) as to primers operating at medium voltage (for instance 200 volts).

The primer of the invention can also be used for detonators which must withstand substantial accelerations.

Furthermore, the shape of the electrodes 6 and 7 and that of the resistor 10 connected in parallel with the conductive pyrotechnical composition 3 may be different from that shown in the figures.

Moreover, the resistor 10 may be made of any suitable material having a resistivity comparable to that of the conductive composition 3, provided that said resistor is sufficiently stable as a function of the energy which is applied to it.

I claim:

1. Electrical primer comprising a conductive pyrotechnical priming composition placed in contact with a useful pyrotechnical charge, and two electrodes in electrical contact with the conductive pyrotechnical composition, the two electrodes being further connected to a stable electrical resistor whch is thereby connected in parallel to the conductive pyrotechnical composition, one of the electrodes comprising a metallic washer, the remaining of said electrodes comprising a metallic body having a flat surface parallel to a surface of said washer, said surfaces being separated by a washer of electrical resistance material forming said electrical resistor, and said washers forming a cylindrical cavity filled with said conductive pyrotechnical priming composition.

2. An electrical primer according to claim 1, whereby said electrical resistor has an ohmic value which is substantially between 0.8 and 2 times that of the static resistance of the conductive pyrotechnical composition.

3. An electrical primer according to claims 1 or 2, characterized by the fact that the electrical resistor connected in parallel is made of a graphite-filled thermoplastic material.

4. An electric primer according to claim 1, whereby the electrical resistor connected in parallel is made of rubber containing between 3 and 10% of graphite.

5. An electrical primer according to claim 1, whereby the electrically resistant material of said resistor has a resistivity which is substantially between 300 and 2000 ohm-cm.

* * * * *